US007491130B2

(12) United States Patent
Tudek et al.

(10) Patent No.: US 7,491,130 B2
(45) Date of Patent: Feb. 17, 2009

(54) 2DEK BALL RACK

(76) Inventors: Arthur Leonard Tudek, 507 Indiana Ave., Glassport, PA (US) 15045; James Edward Tudek, 407 S. Graham St., Glassport, PA (US) 15232

( * ) Notice: Subject to any disclaimer, the term of this patent is extended or adjusted under 35 U.S.C. 154(b) by 107 days.

(21) Appl. No.: 11/594,445

(22) Filed: Nov. 9, 2006

(65) Prior Publication Data

US 2008/0113823 A1 May 15, 2008

Related U.S. Application Data

(63) Continuation-in-part of application No. 10/979,544, filed on Nov. 3, 2004, now abandoned.

(51) Int. Cl.
*A63D 15/00* (2006.01)

(52) U.S. Cl. ..... 473/40; 473/41

(58) Field of Classification Search ..... 473/40, 473/41, 21, 22, 26, 1

See application file for complete search history.

(56) References Cited

U.S. PATENT DOCUMENTS

| | | | | | |
|---|---|---|---|---|---|
| 230,652 | A | * | 8/1880 | Parker | 473/41 |
| 269,825 | A | * | 1/1883 | Bugg et al. | 211/15 |
| 376,549 | A | * | 1/1888 | Reinert | 473/41 |
| 464,745 | A | * | 12/1891 | Sweet | 473/40 |
| 501,256 | A | * | 7/1893 | Rohrbach | 473/41 |
| 702,108 | A | * | 6/1902 | Marshall | 235/91 B |
| 872,766 | A | * | 12/1907 | Smith | 473/41 |
| 966,552 | A | * | 8/1910 | Hutzel | 473/41 |
| 1,089,262 | A | * | 3/1914 | Post | 473/26 |
| 1,115,911 | A | * | 11/1914 | Dickinson | 473/40 |
| 1,167,137 | A | * | 1/1916 | Treiber | 473/40 |
| 1,260,540 | A | * | 3/1918 | Hogue | 473/41 |
| 1,391,901 | A | * | 9/1921 | McCool | 473/41 |
| 1,499,407 | A | * | 7/1924 | Savoie | 473/41 |
| 1,682,616 | A | * | 8/1928 | Irving | 473/40 |
| 1,796,722 | A | * | 3/1931 | Read | 473/40 |
| 3,423,087 | A | * | 1/1969 | Sowa | 473/41 |
| 3,627,321 | A | * | 12/1971 | Sardo | 473/41 |
| 3,680,859 | A | * | 8/1972 | English | 473/40 |
| 3,794,319 | A | * | 2/1974 | Miller | 473/41 |
| 3,929,333 | A | * | 12/1975 | Kremski | 473/41 |

FOREIGN PATENT DOCUMENTS

| | | | |
|---|---|---|---|
| GB | 2180165 | A * | 3/1987 |
| GB | 2188245 | A * | 9/1987 |

* cited by examiner

*Primary Examiner*—Mitra Aryanpour

(57) ABSTRACT

This invention is a billiard/pool ball rack assembly consisting of a triangular rack and a detachable bottom plate and when joined, serves as a tray to encase the balls that can be hand-filled or gravitational filling. When racking the pool balls, the unit is placed on the playing surface then the bottom plate is released from the triangle while the triangle along with the balls are rolled off the plate to the racking spot and the bottom plate which is now serving as a measuring guage and is resting at the foot rail. Then the triangle with balls are backed up against the bottom plate and the triangle is lifted away from the balls for an most accurate racking.

2 Claims, 4 Drawing Sheets

2DEK BALL RACK

This patent application is a continuation-in-part application of application Ser. No. 10/979,544, filed on Nov. 3, 2004 now abandoned.

BRIEF SUMMARY OF THE INVENTION

This invention of a triangular rack with a bottom, detachable plate is most advantageous for usage on all pool tables, namely, drop pockets and ball return tables of all sizes.

One of the many advantages of this present invention is the accuracy in which the balls are pin-pointed spotted for racking. The historic method of racking was and now is when the racker places a shaped rack on the table to hand-fill it and pushes the rack of balls to the racking spot. The racker cannot see the racking spot because the lead ball is covering the racking spot, so the racker must approximate the correct location. The racker might push the unit a little over the racking spot or might not bring the unit up far enough. In the same motion, might turn the unit a few degrees off to the left or right.

Describing the present invention, the triangle with balls, along with the bottom plate are placed at the foot rail. The racker then disengages the triangle from the bottom plate and rolls the triangle with balls off said plate to the racking spot, then backs up the triangle with balls against the front of said plate which is resting at the foot rail, then lifting the triangle from the balls resulting in a perfect alignment.

Another advantage of the present invention is the usage in pool parlors where drop pocket table are furnished. Pool parlors generally supply a separate tray of balls for the players to take to the table. Then the player must secure a rack and then transfer the balls from the tray to a rack to rack the balls. This present invention will eliminate the cumbersome transfer and the inaccuracy of the racking.

Still another advantage that is also related to drop pocket tables. After a game is finished and balls are pocketed, the players usually retrieve the balls from the pockets and toss/roll the balls to the racking spot where the racker loads the balls into the rack to frame the balls with limitted accuracy, With this present invention, the racker can glide the unit to all pockets and placing the balls into the unit for accurate racking and eliminating some wear of the cloth because players inadvertently toss to drop the balls onto the playing surface.

Another big advantage of this invention is the ability of this rack is to catch and corral all of the balls that roll into the collection bin of ball-return table. This is accomplished by supplying a hole under the collection bin and placing the 2dek rack under collection bin thus allowing the balls to fall into and fill up by gravity to be lifted unto the table in one sweep instead of numerous hand-picking from the collection bin to the table top.

SUMMARY OF THE INVENTION

The principal object of this present invention is to provide a triangular rack in combination with a detachable, bottom plate to act as a tray to receive and hold pool balls for transfer and accurate racking.

Another object is to provide spring-loaded, hand-knobs located on top surface of the triangular rack for the purpose of manipulating said device with the assistance of connecting rods exiting the bottom of said triangle and being bent at right angles, (L shaped), to engage or disengage the bottom plate from the triangle.

Another object is the provision of sliding guage that is set in two channels located at the underside of said bottom plate of the device to provide a means for the sliding guage to be set at the exact spot to accomodate different table sizes. This is accomplished by having a series of small holes (four on each side) with embedded, threaded nuts to coincide with their respective pool table size. The sliding guage rides in tracks supplied on the underside of the bottom plate of the device. At the front of said plate, two small holes, one on each side, spaced apart the same distance as are the two rows of small holes of the sliding guage. The two holes of the sliding guage that represent the correct size is matched to the two holes of the device's bottom plate. A bolt is screwed into the threaded hole of the guage to secure it.

Still another object is the provision of three small discs attached to the underside of the unit for the purpose of reducing friction when sliding the unit on the cloth of the playing surface.

These and other objects and advantages will be apparent as the specification is considered with accompaying drawings, wherein.

Figure 1:
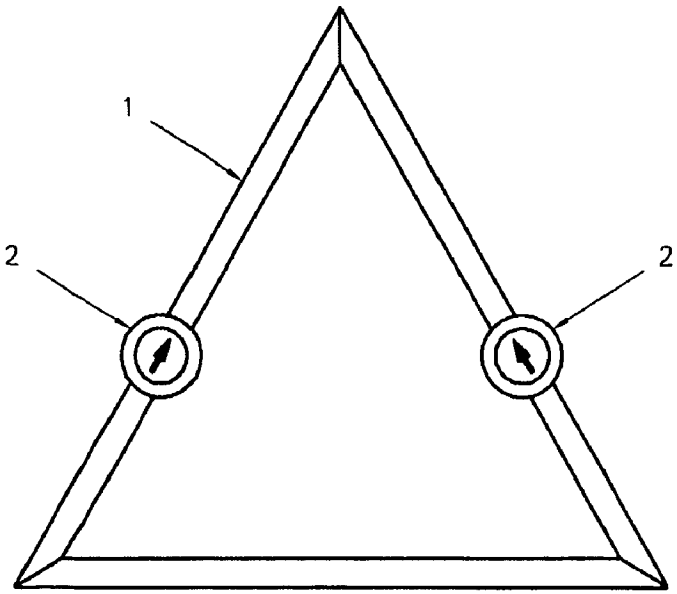
FIG. 1 is a plan view of the triangular rack.

Referring more particularly to the drawings, as best shown in FIG. 1 numeral 1 shows the triangular rack with hand-knobs 2.

Figure 2:
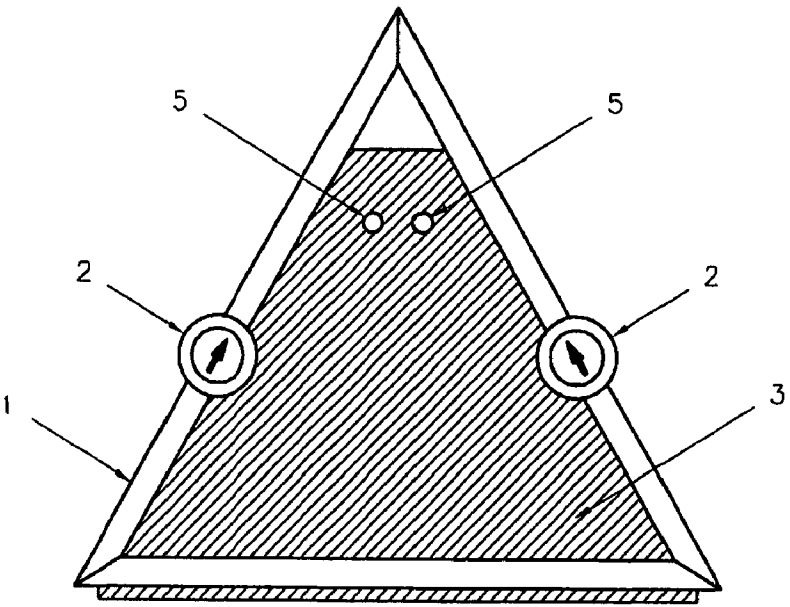
FIG. 2 is a plan view of the complete device with the bottom plate, shaded.

FIG. 2 shows triangular rack 1 with hand-knobs 2 and the shaded, bottom plate 3 and the pilot holes 5 to secure the sliding guage 10.

Figure 3:
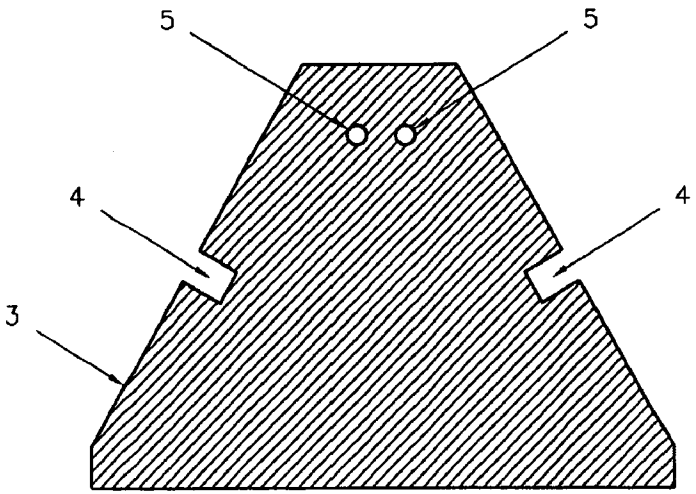
FIG. 3 is a plan view of the bottom plate.

FIG. 3 shows bottom plate 3 and hook slots 4 on each side of bottom plate 3 and pilot holes 5.

Figure 4:
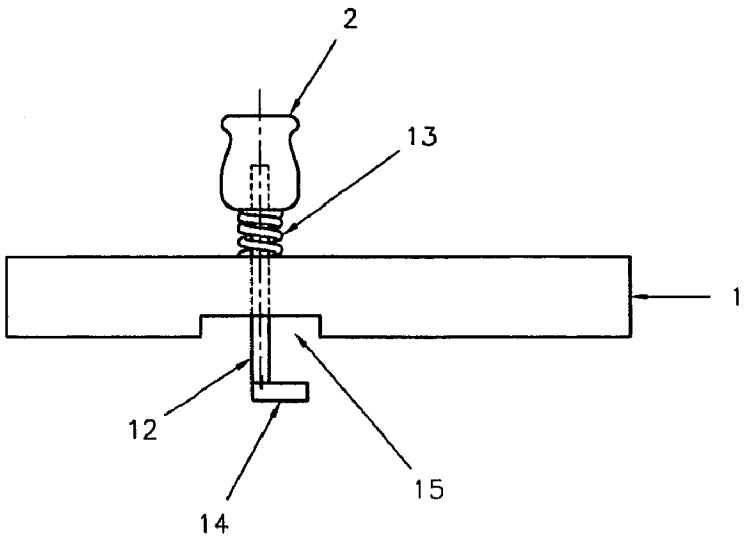
FIG. 4 is an elevated view of one of the two vertical walls of the triangle.

FIG. 4 shows an abbreviated drawing of one of the vertical walls of triangular rack 1 with the hand-knobs 2 and directly under hand-knob 2 is a spiral, compression spring 13 and embedded in hand-knob 2 is a rod 12 which is bent at a right angle to form a hook 14. The slot 15 in triangular rack 1 is to receive and countersink the hook 12 when spiral spring 13 is un-tensioned.

Figure 5:
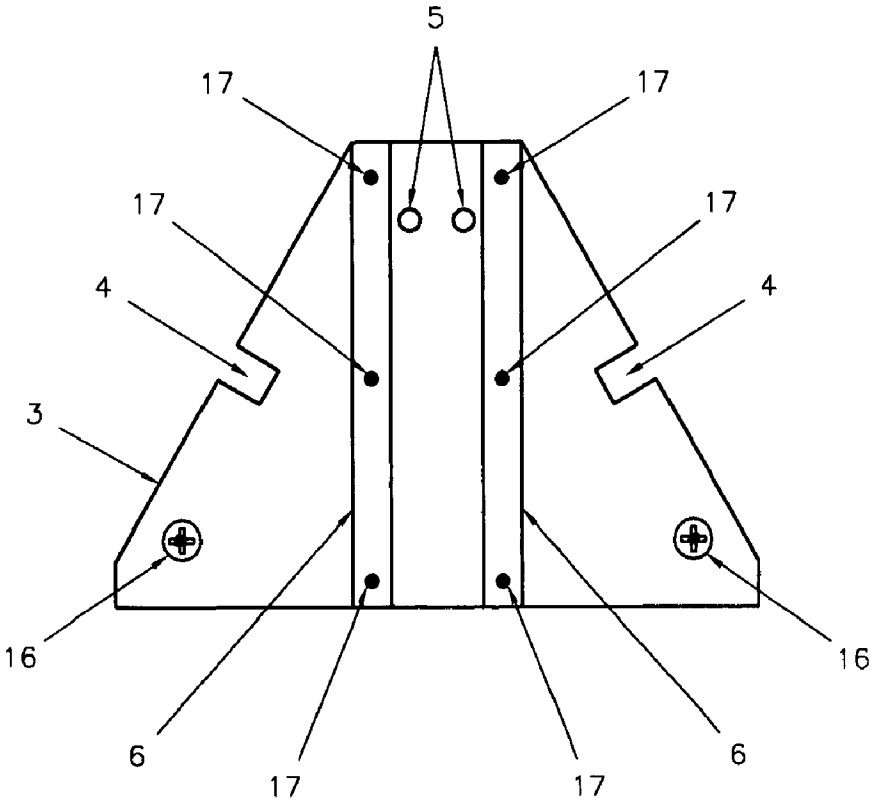
FIG. 5 is a bottom view depicting the channels adhered to the bottom plate.

FIG. 5 shows the underside of the bottom plate 3 and the hook slots 4 on each side of bottom plate 3. Two small pilot holes 5 are provided to engage the holes of the sliding guage 10 in FIG. 6. Two long channel strips 6 as secured to bottom plate 3 with rivets 17. Two sliding discs 16 are fastened at the base corners of bottom plate 3.

Figure 6:
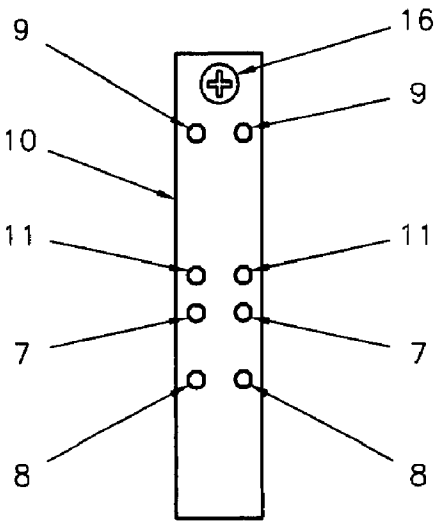
FIG. 6 is the sliding guage.

FIG. 6 shows the sliding guage 10 with two rows of four holes, 7,8,9 and 11 representing the four main sizes of pool tables (39"×78", 44"×88", 46"×92" and 50"×100") when sliding guage 10 is placed into channel strips 6 of FIG. 5. One sliding disc 16 is fastened at top of sliding guage 10 and when sliding guage 10 is placed in the channel strips 6, the sliding disc 16 forms a triangular configuration to stabilize and balance the bottom plate 3 for smooth sliding over the cloth of the table.

Figure 7:
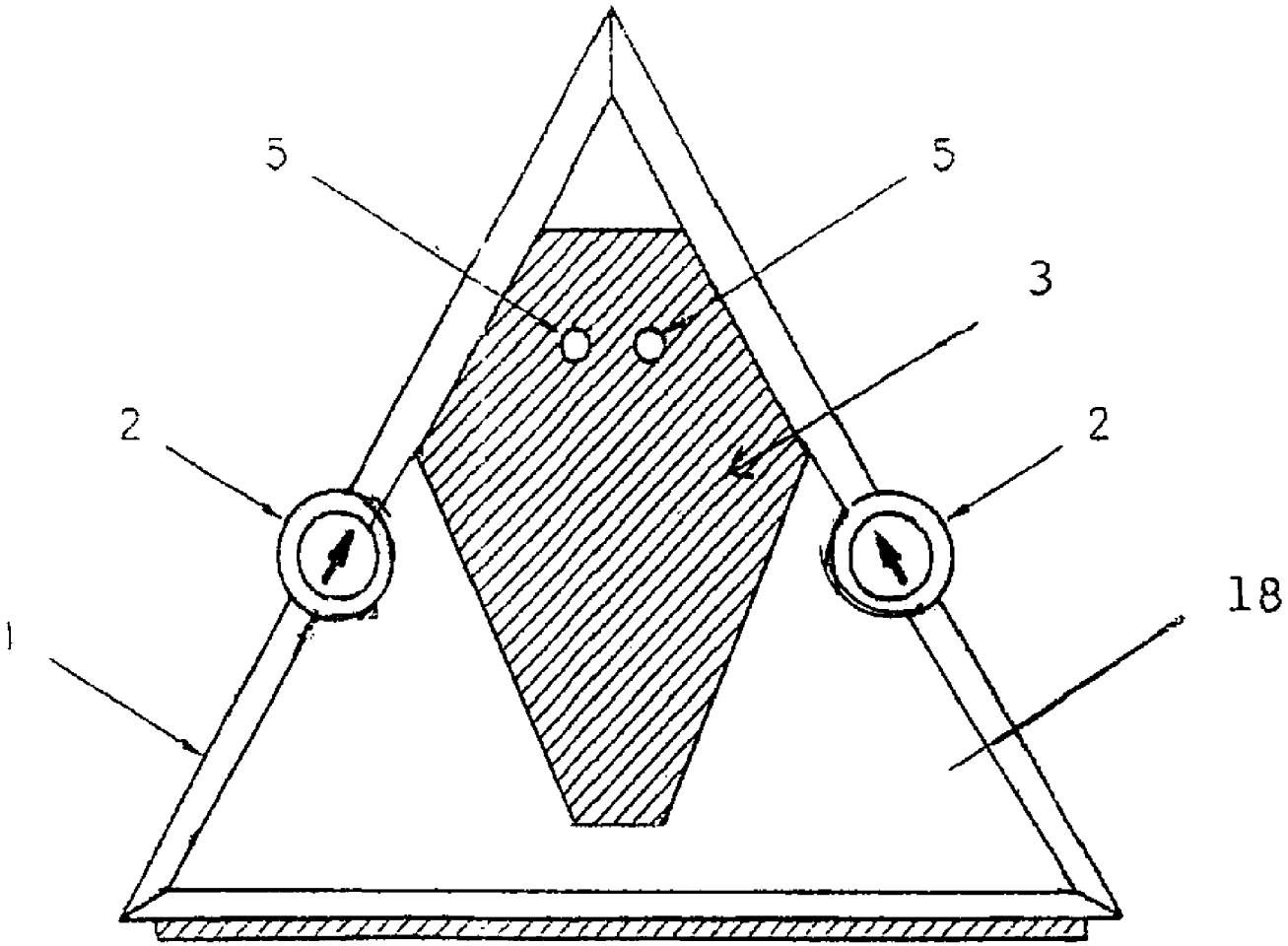
FIG. 7 is a plan view of the device with a solid, one piece insert for the game of "9-ball" and its racking. (darkened).

FIG. 7 shows triangular rack 1 with hand-knobs 2 and shaded bottom plate 3 with pilot holes 5 and "9-ball insert 18, which is darkened.

CROSS REFERENCE TO PRIOR ART

In U.S. Pat. No. 5,716,285, Maceri shows a pool ball rack with a ball frome with a triangular plate defining an inner frame of which can retain a number of balls. Maceri's primary function in his invention is to load balls from below the top surface of the table and transfer the frame onto the top surface of the table for racking. This present invention does have a triangular plate to retain the balls with the device, but said triangular plate is uitlized as measuring template to guide the rack to the exact racking spot.

In U.S. Pat. No. 501,256 Rohrbach shows a device with a bottom plate to contain the balls and also has handles to open the two piece plate to allow the balls to fall onto the table. Rohrbach's objects, functions, and nomenclature is distinctly different. This present invention's primary object and function is the rack pool balls most accurately with the aid and utililization of the bottom plate and used as a measuring guage.

In U.S. Pat. No. 5,997,404, Sardo shows hand grips on his racking device in which the primary purpose for the hand grips is to push the balls into the cloth so that the balls don't move after the rack is lifted. Sardo's patent does not reveal any other accuracy except for all the balls to be inter-connected.

In U.S. Pat. No. 6,024,649, Tudek shows a ball rack with a T-Square device connected to the rack for consistent accuracy when said T-Square is abutted against the foot rail. This present invention has the same accuracy but has more advantages, such as retaining balls to carry and transfer. It is more compact and easier to handle and store.

The invention claimed is:

1. A triangular-shaped ball rack for use on pool tables, the triangular-shaped ball rack comprising:

a first vertical wall, a second vertical wall and a vertical end wall connecting the first and second vetical walls; wherein the walls include upper and lower surfaces;

each of the first and second vertical walls including a hole placed centrally along the length of the vertical walls and extending diametrically from the upper surface to the lower surface of the vertical walls;

a L-shaped rod is moveably received in each hole, each L-shaped rod having a first end and a second end;

a first and second spring-loaded hand knobs; the spring-loaded hand knobs received on the top surface of the first and second vertical walls, and each first end of the L-shaped rods operatively receiving one of the first and second spring-loaded hand knobs;

a trapezoid-shaped bottom plate removable positioned below the triangular-shaped ball rack, the trapezoid-shaped bottom plate including a first side, a second side, an upper and a lower parallel sides, a rectangular slot positioned in each of the first and second sides, wherein the bottom plate is utilized as a measuring guage for accurate racking of balls;

the second end of the L-shaped rods engaging the rectangular slots in the trapezoid-shaped bottom plate;

wherein the hand knobs manipulate the ball rack to engage and disengage from the trapezoid-shaped bottom plate allowing the pool balls to be accurately racked;

a plurality of discs positioned on the base of the trapezoid-shaped bottom plate, wherein the discs reduce friction when sliding the triangular-shaped ball rack on a pool table;

a pair of channel strips attached to the underside and the trapezoid-shaped bottom plate to receive slidable guage with settings to guage all sizes of pool tables.

2. The ball rack of claim 1, further including a solid, continuous, single-piece double triangles having a height approximately the same height as the ball rack, wherein when the double-triangles is placed in the ball rack, the ball rack can be converted from a 15-ball rack into a 9-ball rack.

* * * * *